United States Patent [19]

Claesson et al.

[11] 4,136,918

[45] Jan. 30, 1979

[54] PLUG FOR MAKING ELECTRICAL INTERCONNECTION

[75] Inventors: Tore V. Claesson; Gustav R. A. Gustavsson, both of Sandviken, Sweden

[73] Assignee: Sandvik Aktiebolag, Sandviken, Sweden

[21] Appl. No.: 831,387

[22] Filed: Sep. 8, 1977

[30] Foreign Application Priority Data

Sep. 20, 1976 [SE] Sweden ..... 7610379

[51] Int. Cl.[2] ..... H01R 29/00

[52] U.S. Cl. ..... 339/31 R

[58] Field of Search ..... 339/31 R, 31 B, 31 M, 339/31 L, 31 T, 32 R, 32 M, 33, 34, 196 A

[56] References Cited

U.S. PATENT DOCUMENTS 2,957,156 10/1960 Gatto et al. ..... 339/31 R

*Primary Examiner*—Neil Abrams

*Attorney, Agent, or Firm*—Burns, Doane, Swecker & Mathis

[57] ABSTRACT

The electric plug of the present invention including a base plate, a yoke, a case movable over said yoke and a pair of flat contact pins of American type and also a pair of round pins of European type. The flat contact pins are fixed in the base plate of the plug, while the round contact pins are located in that part of the plug consisting essentially of yoke and case. When the case is drawn upwardly over the yoke, the two components can be tilted as a unit about journals in the base plate so as to expose the flat contact pins for use. When the case is pushed down over the yoke, the round contact pins are exposed for use.

9 Claims, 4 Drawing Figures

PLUG FOR MAKING ELECTRICAL INTERCONNECTION

This invention relates to the electrical apparatus art, and is concerned with a novel electrical plug.

Some light-weight pieces of electric apparatus can be connected with an electrical outlet in the wall by means of a plug fastened to the cover of the apparatus. Examples of this are load-sets for small motor-driven tools, calculating machines and for some electric-light apparatuses. As American standard is different from European as to plugs there earlier have been load-sets with one type of plugs for American use and other load-sets with another type of plugs for European use.

The present invention is concerned with a plug which can be shifted between American type of flat pins and European type of round pins and which is disclosed in greater particularity hereinafter and with reference to the accompanying drawing, in which FIG. 1 is an embodiment of the invention in a position in which the plug can be connected with a contact of American type by pivoting the case and the yoke;

Figure 1:
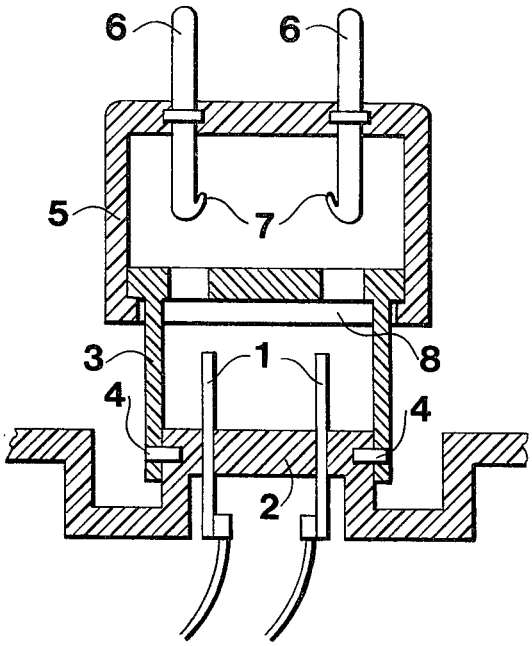
Figure 2:
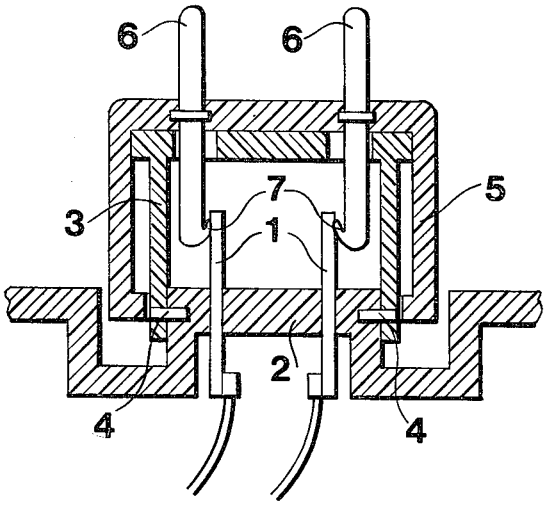
FIG. 2 is the same embodiment in a position in which the plug can be connected with a contact of European type.

The plug according to FIGS. 1 and 2 is provided with two flat contact pins 1 of American type upstanding from a base plate 2. At the sides of the base plate a yoke 3 of electrically-insulating material is journalled as at 4, 4, which yoke can be tilted or pivoted about journals 4, 4. A case 5, also of electrical insulating material, can be moved along yoke 3 and supports round contact pins 6, 6, according to European standard in its outer part. These contact pins are provided with elastic contact devices 7 at their ends being situated inside the case. The upper part of yoke 3 is provided with apertures 13, 13 in alignment with and adapted to pass round contact pins 6, 6 when case 5 is pushed down over yoke 3.

At the connection with a contact of American type the case 5 shall be drawn up (i.e., out) and, together with yoke 3, be tilted aside, for instance into a recess in the side of the apparatus. Thereby the flat pins are uncovered and connection of the latter to an outlet in the wall can be made. At connection with a contact of European type the yoke 3 and case 5 are tilted up so that the case is brought straight over flat pins 1; then the case is pushed down until pins 6, 6 project through apertures 13, 13 and contact devices 7, 7 touch pins 1. The contact devices 7, 7 do not touch the flat pins 1 before the case 5 is pushed down so far along yoke 3 that the lower edge 8 of the case surrounds base plate 2. This means that in this position case and yoke no longer are tiltable about journals 4, 4, whereby the flat pins 1 become quite inaccessible.

Figure 3:
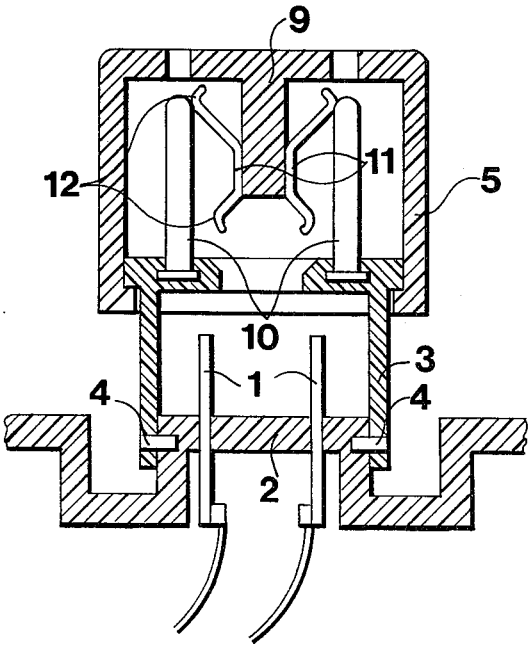
FIG. 3 is another embodiment of the invention in the same position as that shown in FIG. 1.
Figure 4:
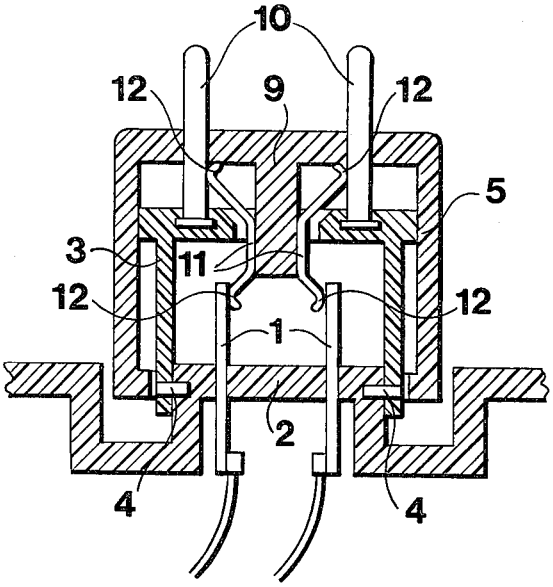
FIG. 4 is the same embodiment as in FIG. 3 but in the same position as that shown in FIG. 2.

The embodiment according to FIGS. 3 and 4 is different from the first embodiment owing to the fact that round contact pins 10 are fastened to yoke 3' instead of to case 5', and that instead of projections 7 on contact pins 6, 6 as illustrated in FIGS. 1 and 2 the contact devices consist of two metal plates 11 provided with elastic projections at both their ends, as illustrated in FIGS. 3 and 4, which case or plates are fastened to a tap 9 extending inwards from the top of case 5'. The contact device may consist of a thin metal case which is fastened onto the tap in place of the metal plates.

In the second embodiment, the upper part of case 5' is provided with two apertures 13', 13' in alignment with round contact pins 10. Round contact pins 10, 10 have such a length, compared to the length of the stroke of case 5' that when case 5' is pushed down over yoke 3' said round contact pins extend a substantial distance through said apertures 13', 13' adapted to make electrical connection with a wall outlet. Metal plates 11 have such configuration that the elastic projections 12 at their upper ends contact round contact pins 10 while at their lower ends elastic projections 12 are in alignment with flat contact pins 1 and actually contact the latter when case 5' is pushed down along and over yoke 3' (as illustrated in FIG. 4).

As can be seen in FIG. 3, case 5' and yoke 3' can, when the case is drawn upward over the yoke, be tilted as a unit to one side so as to expose flat contact pins 1 for insertion into a wall outlet.

The use and the shifting between American and European standard are made, in the FIGS. 3, 4 embodiment, made in the same way as in the first embodiment.

The invention is not limited to the mentioned embodiments but can be varied within the scope of the following claims.

We claim:

1. A plug having contact pins for insertion into an electrical outlet comprising a base plate and an element which comprises a yoke and a case movably arranged over said yoke, said plug having two pairs of contact pins of which one pair is fastened to said base plate, in which plug said case and said yoke are pivotingly mounted on pivot means on said base plate for pivotal movement of said case and yoke as a unit about said pivot means, and the second pair of contact pins is fastened to said element, whereby the first pair of contact pins can be connected with the second pair of contact pins by contact means to adapt said second pair of contact pins for insertion into the outlet or alternatively said case and yoke can be jointly moved about said pivot to expose said first pair of contact pins for insertion into said outlet.

2. The plug of claim 1, wherein the first pair of contact pins are flat contact pins.

3. The plug of claim 1, wherein the second pair of contact pins are round contact pins.

4. The plug of claim 3, in which the round contact pins are fastened to the case whereby one part of the pins is situated outside the case and another part inside the case.

5. The plug of claim 3, in which the round contact pins are fastened to the yoke.

6. The plug of claim 5, wherein the case is provided with a tap extending inwardly from the top of the case.

7. The plug of claim 6 wherein said contact means being fastened to the tap.

8. The plug of claim 7 wherein said contact means comprises two contact devices each having two end portions such end portions of the contact devices being provided with elastic projections for contact with both the round and flat pins.

9. The plug of claim 4 wherein, said contact means comprise elastic contacts disposed at ends of said round pins and positioned to contact said flat pins.

* * * * *